US007464468B2

(12) United States Patent
Kim

(10) Patent No.: US 7,464,468 B2
(45) Date of Patent: Dec. 16, 2008

(54) STRUCTURE FOR INLAYING PRECIOUS METAL IN AN OUTER PERIPHERAL SURFACE OF A RING AND METHOD FOR MANUFACTURING A RING INLAID WITH PRECIOUS METAL IN AN OUTER PERIPHERAL SURFACE

(75) Inventor: Seong-Hoon Kim, Gangnam-Gu (KR)

(73) Assignee: S. Will International Co., Ltd (KR)

( * ) Notice: Subject to any disclaimer, the term of this patent is extended or adjusted under 35 U.S.C. 154(b) by 291 days.

(21) Appl. No.: 11/415,755

(22) Filed: May 1, 2006

(65) Prior Publication Data

US 2007/0227003 A1 Oct. 4, 2007

(30) Foreign Application Priority Data

Mar. 31, 2006 (KR) ..... 10-2006-0029409

(51) Int. Cl.
*A44C 27/00* (2006.01)
*A44C 9/00* (2006.01)

(52) U.S. Cl. ..... 29/896.412; 63/15

(58) Field of Classification Search ..... None
See application file for complete search history.

(56) References Cited

U.S. PATENT DOCUMENTS 1,431,652 A * 10/1922 Grossman ..... 29/8
1,865,392 A * 6/1932 Hutchinson et al. ..... 451/52
6,062,045 A * 5/2000 West ..... 63/15
6,546,749 B1 * 4/2003 Canty ..... 63/3
6,553,667 B1 4/2003 West
6,928,734 B1 * 8/2005 West ..... 29/896.412
6,990,736 B2 * 1/2006 West ..... 29/896.412
6,993,842 B2 * 2/2006 West ..... 29/896.412
7,032,314 B2 * 4/2006 West ..... 29/896.412
7,076,972 B2 * 7/2006 West ..... 63/15
2004/0020242 A1 * 2/2004 West ..... 63/15
2006/0048542 A1 * 3/2006 Barry ..... 63/15.7
2006/0254314 A1 * 11/2006 West ..... 63/15

* cited by examiner

*Primary Examiner*—Jack W. Lavinder
(74) *Attorney, Agent, or Firm*—Holland & Hart

(57) ABSTRACT

Disclosed are structure for inlaying precious metal in and outer peripheral surface of a ring and method for manufacturing a ring inlaid with precious metal in an outer peripheral surface. The ring includes a annular blank obtained by compressing a powdered mixture including 80 to 85 weight percent of tungsten carbide in a mold by means of a hydraulic press, and a precious metal inlaid in an outer peripheral surface of the annular blank after sintering the annular blank. An annular groove is formed at an outer peripheral surface of the annular blank, in which the annular groove is defined by sidewalls, which are inwardly inclined in a downward direction, and a bottom wall. Inclined slots having a gradient identical to that of the inclined sidewalls are formed at both lower edge portions of the annular groove, in which the lower edge potions are defined between the bottom wall and the inclined sidewalls. The precious metal is inlaid in the annular groove and the inclined slots in such a manner that an upper surface of the precious metal and the outer peripheral surface of the annular blank is the same level.

4 Claims, 4 Drawing Sheets

STRUCTURE FOR INLAYING PRECIOUS METAL IN AN OUTER PERIPHERAL SURFACE OF A RING AND METHOD FOR MANUFACTURING A RING INLAID WITH PRECIOUS METAL IN AN OUTER PERIPHERAL SURFACE

BACKGROUND OF THE INVENTION

1. Field of the Invention

The present invention relates to structure for inlaying precious metal in an outer peripheral surface of a ring and method for manufacturing a ring inlaid with precious metal in an outer peripheral surface.

2. Description of the Prior Art

As generally known in the art, conventional rings are classified into rings containing precious metals, such as gold or silver of soft materials, and rings having expensive jewels inlaid in an outer peripheral surface thereof.

Such conventional rings are made of soft materials, so that surfaces of the rings may be easily scratched. In addition, such conventional rings are so expensive that they cannot be extensively used as accessories.

In this regard, low-price rings capable of preventing surfaces thereof from being scratched have been developed.

Such low-price rings can be obtained through performing a series of processes of providing a powdered mixture containing at least 50 weight percent of tungsten carbide which is a rigid material used for a watchband or a bearing, compressing the powdered mixture through powder metallurgy, sintering the metallic material, and grinding/polishing the metallic material in the form of the ring.

Since the rings are made from the rigid material, the rings have rigid surfaces, so that the surfaces of the rings can be prevented from being scratched. In addition, since the rings are highly polished through the grinding/polishing process, the rings have superior luster characteristics, so that the rings are favorably commented in Western countries.

However, the conventional rings made of rigid materials, other than precious metals such as gold or silver, have not yet been extensively used in Oriental countries. This is because Oriental countries customarily prefer rings containing precious metals.

For instance, U.S. Pat. No. 6,928,734 discloses a ring, in which an annular groove is formed at an outer peripheral surface of the ring, which is made of a rigid material through powder metallurgy, and precious metal is inlaid in the annular groove.

However, in the ring disclosed in the above patent, a gap is formed between the annular groove provided in the outer peripheral surface of the ring through powder metallurgy and the precious metal (gold or silver) inlaid in the annular groove, so foreign materials may penetrate into the gap, thereby deteriorating an external appearance of the ring as well as enabling the soft precious metal inlaid in the annular groove to easily moving in the annular groove. In addition, the soft precious metal inlaid in the annular groove may be easily separated from the annular groove if a person takes off the precious metal by inserting a sharp tool, such as an awl, into the gap.

SUMMARY OF THE INVENTION

Accordingly, the present invention has been made to solve the above-mentioned problems occurring in the prior art, and an object of the present invention is to provide structure for inlaying precious metal in an outer peripheral surface of ring and method for manufacturing a ring inlaid with precious metal in an outer peripheral surface, in which the ring is inlaid with a precious metal in the form of an annular band without forming a gap between the ring and the precious metal, so that the precious metal can be prevented from being easily separated from the ring even if a sharp tool is inserted into the gap.

In order to accomplish this object, according to the present invention, there is provided method for manufacturing a ring inlaid with precious metal in an outer peripheral surface, the method comprising the steps of: fabricating an annular blank by compressing a powdered mixture including tungsten carbide; sintering the annular blank; primarily polishing upper, lower, inner peripheral and outer peripheral surfaces of the sintered annular blank by a wheel of which an outer peripheral surface is attached with diamond powder, and forming curved surfaces in both lateral sides of the inner peripheral surface of the annular blank by grinding the both lateral sides of the inner peripheral surface of the annular blank using the wheel; smoothing the surfaces of the annular blank by inputting the polished and ground annular blank in a container together with abrasives and rotating and vibrating the container; secondarily polishing the inner and outer peripheral surfaces of the annular blank by a buffing tool of which an outer peripheral surface is attached with diamond powder; fixing the secondarily polished annular blank to a rotary jig, and performing a grooving process with respect to a center portion of the outer peripheral surface of the annular blank for 30 to 35 hours by the wheel thereby forming an annular groove on the outer peripheral surface of the annular blank; slantingly cutting both sidewalls of the annular groove in a downward direction by means of a diamond bite, thereby forming inwardly inclined sidewalls at both sides of the annular groove, and forming inclined slots having a gradient identical to that of the inclined sidewalls at both lower edge portions of the annular groove, in which the lower edge portions are formed between a bottom wall and both inclined sidewalls defining the annular groove; preparing a strip type precious metal having a predetermined length and a predetermined thickness forming a predetermined volume, which is 1.1 to 1.5 times larger than that of the annular groove, fitting the annular blank around a tapered rod, manually inserting one end of the strip type precious metal into the annular groove, and striking the strip type precious metal against the bottom surface of the annular groove lengthwise along the strip type precious metal from the one end of the strip type precious metal to the other end by using an iron hammer; and removing a step difference between an upper surface of the precious metal and the outer peripheral surface of the annular blank by finely cutting the outer peripheral surface of the annular blank together with the upper surface of the precious metal using a diamond bite.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
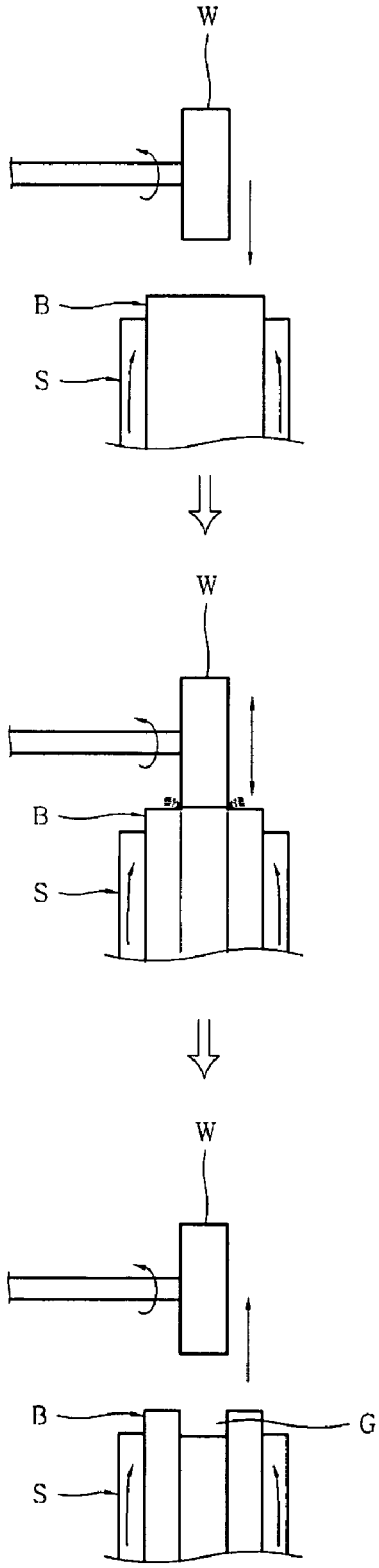
FIG. 1 is a schematic view for explaining a grooving process according to one embodiment of the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

A method for manufacturing a ring according to one embodiment of the present invention will be described below with reference to FIGS. 1 to 4.

First, a powdered mixture containing tungsten carbide is prepared.

The powdered mixture includes tungsten carbide powder, chrome carbide powder, and nickel carbide powder, which are mixed in a predetermined mixing ratio.

Preferably, the powdered mixture includes 80 to 85 weight percent of tungsten carbide, 2 to 4 weight percent of chrome carbide, and 11 to 16 weight percent of nickel carbide.

Then, the powdered mixture is put into a mold and is compressed by means of a hydraulic press, thereby obtaining an annular blank.

After that, the annular blank is introduced into an electric furnace, and a sintering process is performed under predetermined conditions with respect to the annular blank.

For instance, the annular blank is sintered in the electric furnace of a vacuum state for 40 to 50 hours under the temperature of 1750 to 1850° C.

Then, a bottom surface of the sintered annular blank is bonded to a base by using an adhesive, and then, an upper surface of the sintered annular blank is polished/ground by means of a wheel of which an outer peripheral surface is attached with diamond powder. After that, the sintered annular blank is taken off from the base and the polished upper surface of the sintered annular blank is bonded to the base by using an adhesive. In this state, the bottom surface of the sintered annular blank is polished/ground by means of the wheel, so that both the bottom and upper surfaces of the annular blank are primarily polished.

Thereafter, the annular blank bonded to the base is taken off from the base, and then an inner peripheral surface of the annular blank and both lateral sides of the inner peripheral surface of the annular blank are polished/ground by means of the wheel, so that the inner peripheral surface of the annular blank is primarily polished and curved surfaces are formed in both lateral sides of the inner peripheral surface of the annular blank in such a manner that a user can easily put the annular blank on a user's finger or take off the annular blank.

Then, an outer peripheral surface of the annular blank is polished/ground by means of the wheel, so that the outer peripheral surface of the annular blank is primarily polished.

After that, the annular blank is inputted into a container together with grinding aids or abrasives, such as silica. In this state, the container is rotated or vibrated in such a manner that scars, burrs or scales can be removed from the annular blank. Accordingly, it is possible to obtain the annular blank having smooth surfaces.

After that, the inner and outer peripheral surfaces of the annular blank are secondarily polished by means of a buffing tool, which consists of a wheel made from a flexible material, such as a rag, a belt or leather, and diamond powder attached to an outer peripheral surface of the wheel.

Then, the annular blank B, which has undergone the secondary polishing process, is fixed to a rotary jig S. In this state, as shown in FIG. 1, the center portion of the outer peripheral surface of the annular blank B is subject to the grooving process. The grooving process is performed for 30 to 35 hours by means of a wheel W of which an outer peripheral surface is attached with diamond powder, thereby forming an annular groove G having a predetermined depth at the outer peripheral surface of the annular blank B.

Due to the following reasons, the grooving process must be performed for a long time with respect to the center portion of the outer peripheral surface of the annular blank in order to form the annular groove at the outer peripheral surface of the annular blank.

Since the annular blank B is made from rigid material having a fragile property, such as tungsten carbide, it is difficult to cut the annular blank B by a typical cutting tool, so a diamond tool is used to cut or grind the annular blank B. However, although the annular blank B has superior rigidity, it also has fragility. Therefore, if a diamond cutting bite is used in order to rapidly form the annular groove G in the annular blank B, the annular blank B will be subject to great impact, so that the annular blank B may be broken during the cutting process.

For this reason, the grinding wheel of which an outer peripheral surface is attached with diamond powder is used to form the annular groove in the outer peripheral surface of the annular blank. In this case, the grinding wheel grinds and cuts the annular blank with its being line-contacted to the annular blank, so that the annular blank can be prevented from being broken, but a relatively long time is necessary to form the annular groove having the predetermined depth in the annular blank.

Figure 2:
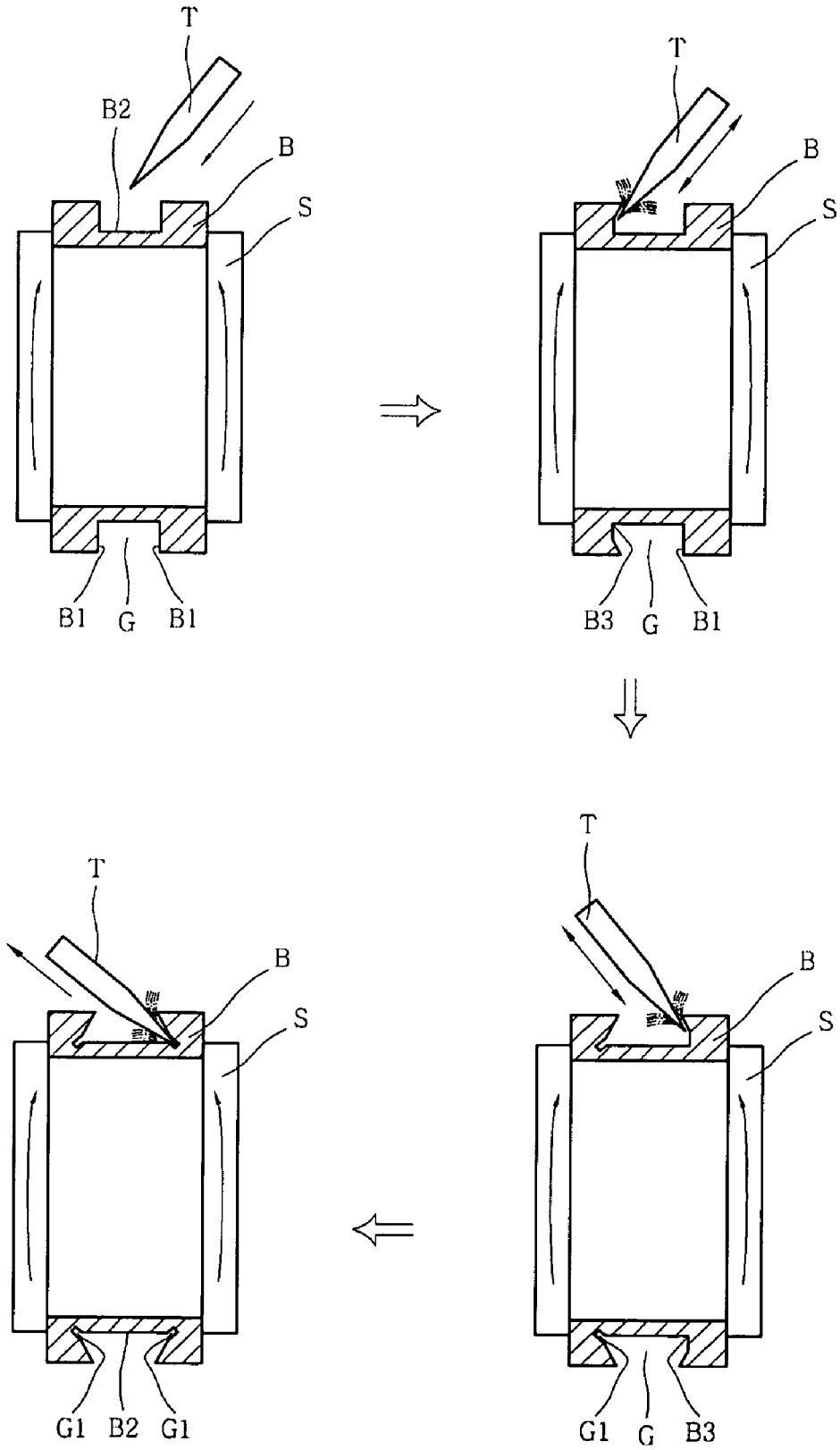
FIG. 2 is a schematic view illustrating the procedure for processing a groove shown in FIG. 1 such that precious metals can be inlaid in the groove.

Then, as shown in FIG. 2, both lateral walls B1 of the annular groove G formed in the annular blank B installed in the rotary jig S are subject to the cutting process. In detail, both sidewalls B1 of the annular groove G are slantingly cut in the downward direction by means of a diamond bite T, thereby forming inwardly inclined sidewalls at both sides of the annular groove G. At the same time, inclined slots G1 having the gradient identical to that of the inclined sidewalls are formed at both lower edge portions B3 of the annular groove G, in which the lower edge portions B3 are formed between a bottom wall B2 and both inclined sidewalls defining the annular groove G.

Figure 3:
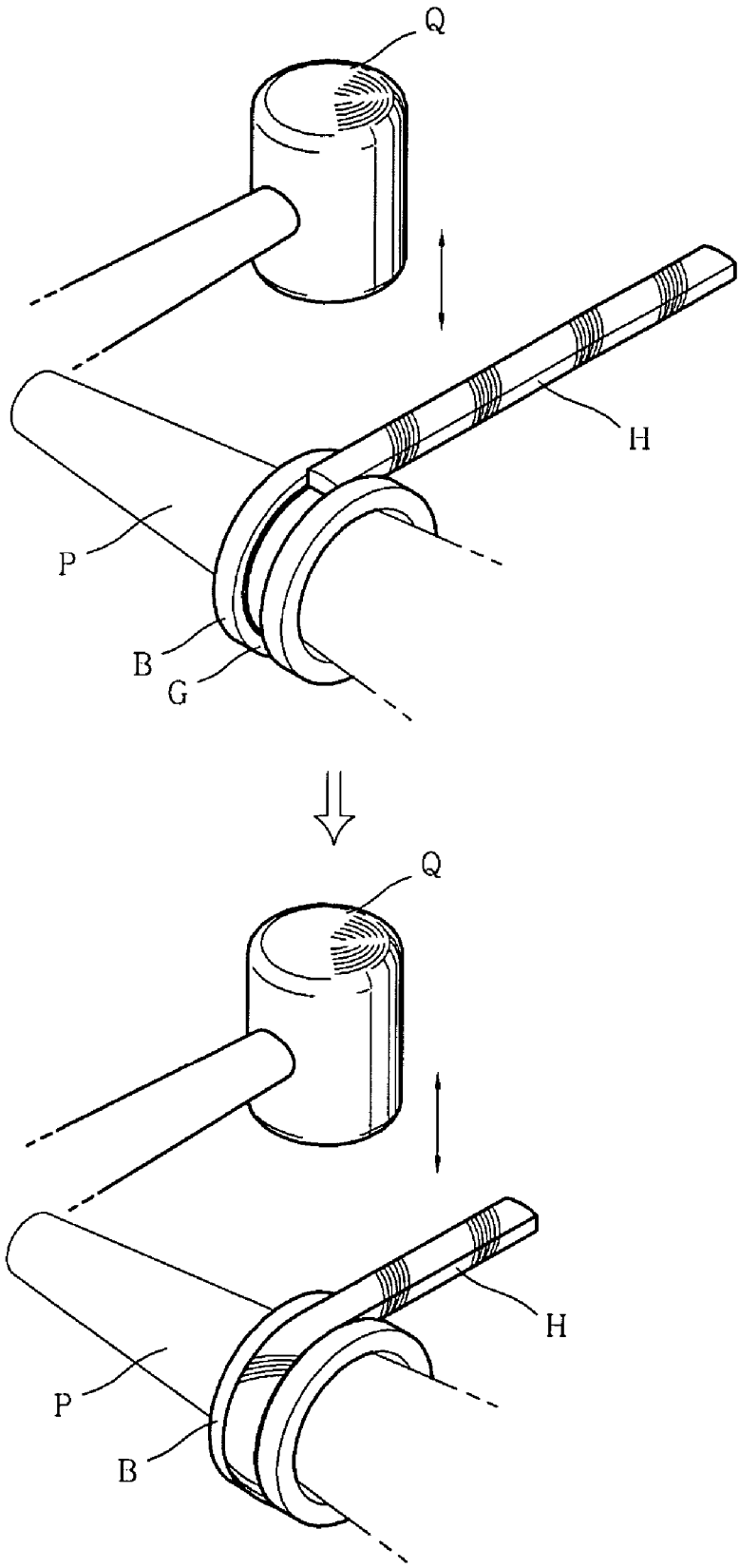
FIG. 3 is a perspective view illustrating the procedure for inlaying precious metals in the groove shown in FIG. 2.

After that, a strip type precious metal (gold or silver) H is prepared. The strip type precious metal H has a predetermined length and a predetermined thickness to form a predetermined volume, which is 1.1 to 1.5 times larger than that of the annular groove G. In addition, as shown in FIGS. 2 and 3, in a state in which the annular blank B is fitted around a tapered rod P, a worker manually inserts one end of the strip type precious metal H into the annular groove G, and then strikes the one end of the strip type precious metal H against the bottom surface B2 of the annular groove G by using an iron hammer Q such that the one end of the strip type precious metal H can be securely fixed in the annular groove G. In this state, the worker continuously strikes the strip type precious metal H lengthwise along the strip type precious metal H while rotating the tapered rod P in such a manner that the strip type precious metal H can be securely fitted in the annular groove G and the inclined slots G1. Accordingly, the strip type precious metal H can be securely fixed in the annular groove G without being moved or separated from the annular groove G, even if external impact is applied thereto, so long as the annular blank is not broken.

Figure 4:
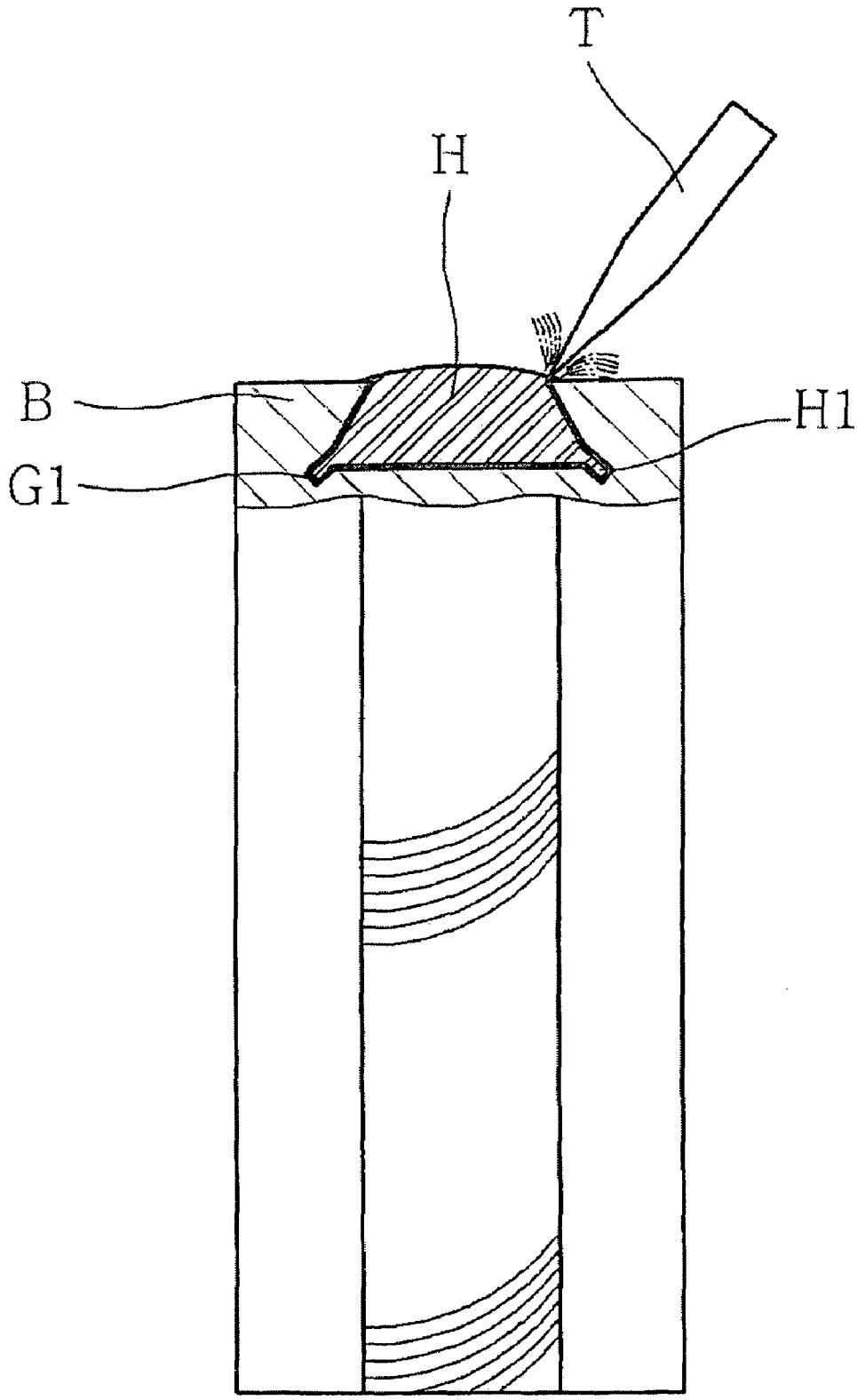
FIG. 4 is a partially sectional view illustrating a precious metal inlaid in the groove shown in FIG. 3.

Herein, as shown in FIG. 4, leg parts H1 of the strip type precious metal H inserted into the inclined slots G1 may expand downward with a width larger than that of the annular groove G, so that the leg parts H1 can serve as anchor bolts.

Since the soft precious metal slightly protrudes out of the annular groove G, before and even after the worker strikes the precious metal, the precious metal serves as an elastic member if the worker strikes the precious metal with weak force by the iron hammer Q, so that great impact is not applied to the annular blank B. Accordingly, the annular blank B can be prevented from being broken and the precious metal H can be press-fitted into the annular groove G and the inclined slots G1.

In addition, great pressure is instantaneously applied to the precious metal H during inlaying the precious metal H in the annular groove G by striking the precious metal H with the iron hammer Q. Thus, a portion of the precious metal H, which makes contact with the annular groove G, is partially melted so that the precious metal H can be securely accommodated in the annular groove G without forming a gap at a boundary area between the precious metal H and the annular groove G.

After that, in order to remove the step difference between the upper surface of the precious metal H inlaid in the annular groove G and the outer peripheral surface of the annular blank, the cutting process is additionally performed by means of a diamond bite so as to finely cut the outer peripheral surface of the annular blank together with the upper surface of the precious metal. Thus, it seems as if the precious metal and the half-finished product are fabricated from the same material, even through the precious metal has a color, which is different from that of the annular blank, thereby increasing the commercial value of the ring.

As described above, according to the method of the present invention, it is possible to provide a ring made of a rigid material with a precious metal being inlaid in the ring in the form of an annular band without forming a gap between the ring and the precious metal, so that the precious metal can be prevented from being easily separated from the ring by a sharp tool.

In addition, an annular groove having a reverse trapezoidal section is formed in the outer peripheral surface of the ring and inclined slots are formed in edge portions formed between the bottom surface and inclined sidewalls of the annular groove, so that the precious metal inserted into the annular groove and the inclined slots may serve as an anchor bolt. Accordingly, the precious metal can be securely fixed in the annular groove without being moved or separated from the annular groove, so long as the ring is not broken.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method for manufacturing a ring which is made of a rigid material and inlaid with a precious metal, the method comprising the steps of:

fabricating an annular blank by compressing a powdered mixture including 80 to 85 weight percent of tungsten carbide in a mold by means of a hydraulic press;

sintering the annular blank in an electric furnace of a vacuum state for 40 to 50 hours under a temperature of 1750 to 1850° C.;

primarily polishing upper, lower, inner peripheral and outer peripheral surfaces of the sintered annular blank by a wheel of which an outer peripheral surface is attached with diamond powder, and forming curved surfaces in both lateral sides of the inner peripheral surface of the annular blank by grinding the both lateral sides of the inner peripheral surface of the annular blank using the wheel;

smoothing surfaces of the annular blank by rotating and vibrating a container after inputting the primarily polished annular blank into the container together with abrasives;

secondarily polishing the inner and outer peripheral surfaces of the annular blank by a buffing tool of which an outer peripheral surface is attached with diamond powder;

fixing the secondarily polished annular blank in a rotary jig, and performing a grooving process with respect to a center portion of the outer peripheral surface of the annular blank for 30 to 35 hours by the wheel, thereby forming an annular groove having a predetermined depth at the outer peripheral surface of the annular blank;

slantingly cutting both sidewalls of the annular groove in a downward direction by means of a diamond bite, thereby forming inwardly inclined slots having a gradient identical to that of the inclined sidewalls at both lower edge portions of the annular groove, in which the lower edge portions are formed between a bottom wall and both inclined sidewalls defining the annular groove;

preparing a strip type precious metal having a predetermined length and a predetermined thickness forming a predetermined volume, which is 1.1 to 1.5 times larger than that of the annular groove, fitting the annular blank around a tapered rod, manually inserting one end of the strip type precious metal into the annular groove, and striking the strip type precious metal against the bottom surface of the annular groove lengthwise along the strip type precious metal from the one end of the strip type precious metal to the other end with an iron hammer; and removing a step difference between an upper surface of the precious metal and the outer peripheral surface of the annular blank by finely cutting the outer peripheral surface of the annular blank together with the upper surface of the precious metal using a diamond bite.

2. The method as claimed in claim 1, wherein the precious metal is one of gold and silver.

3. Inlaying structure of a ring which comprises an annular blank obtained by compressing a powdered mixture including 80 to 85 weight percent of tungsten carbide in a mold by means of a hydraulic press and a precious metal inlaid in an outer peripheral surface of the annular blank after sintering the annular blank, comprising:

an annular groove formed at an outer peripheral surface of the annular blank, in which the annular groove is defined by sidewalls, which are inwardly inclined in a downward direction, and a bottom wall;

inclined slots having a gradient identical to that of the inclined sidewalls and formed at both lower edge portions of the annular groove, in which the lower edge portions are defined between the bottom wall and the inclined sidewalls, and the precious metal inlaid in the annular groove and the inclined slots in such a manner that an upper surface of the precious metal and the outer peripheral surface of the annular blank are the same level.

4. The ring as claimed in claim 3, wherein the precious metal is one of gold and silver.

* * * * *